US008066405B2

(12) United States Patent
Simon

(10) Patent No.: US 8,066,405 B2
(45) Date of Patent: Nov. 29, 2011

(54) LUMENAIRS HAVING STRUCTURALLY AND ELECTRICALLY INTEGRATED ARRANGEMENTS OF QUASI POINT LIGHT SOURCES, SUCH AS LEDS

(76) Inventor: Jerome H. Simon, Newton, MA (US)

( * ) Notice: Subject to any disclaimer, the term of this patent is extended or adjusted under 35 U.S.C. 154(b) by 269 days.

(21) Appl. No.: 12/258,712

(22) Filed: Oct. 27, 2008

(65) Prior Publication Data

US 2009/0147511 A1 Jun. 11, 2009

Related U.S. Application Data

(60) Provisional application No. 61/000,411, filed on Oct. 25, 2007.

(51) Int. Cl.
*F21V 21/001* (2006.01)

(52) U.S. Cl. ..... 362/249.01; 362/249.02; 362/249.04; 362/249.06; 362/249.09; 362/249.14

(58) Field of Classification Search ..... 362/249.01, 362/249.02, 249.04, 249.06, 249.09, 249.14, 362/249.16

See application file for complete search history.

(56) References Cited

U.S. PATENT DOCUMENTS

| | | | | |
|---|---|---|---|---|
| 4,607,623 | A * | 8/1986 | Bauman | 600/197 |
| 5,243,506 | A * | 9/1993 | Whitehead | 362/307 |
| 5,629,057 | A * | 5/1997 | Wang et al. | 428/9 |
| 6,070,991 | A * | 6/2000 | Rumpel | 362/235 |
| 6,135,617 | A * | 10/2000 | Lai | 362/249.09 |
| 6,386,734 | B1 * | 5/2002 | Huang | 362/249.09 |
| 6,401,404 | B1 * | 6/2002 | Fillipp et al. | 52/80.1 |
| 6,616,305 | B1 * | 9/2003 | Simon | 362/309 |
| 6,830,361 | B2 * | 12/2004 | Wang | 362/124 |
| 6,981,791 | B2 * | 1/2006 | Higashiyama | 362/600 |
| 7,439,549 | B2 * | 10/2008 | Marchl et al. | 257/88 |
| 7,677,743 | B2 * | 3/2010 | Hsu et al. | 362/23 |
| 7,775,679 | B2 * | 8/2010 | Thrailkill et al. | 362/237 |

* cited by examiner

*Primary Examiner* — James Lee
*Assistant Examiner* — Mark Tsidulko
(74) *Attorney, Agent, or Firm* — Burns & Levinson LLP; Harvey Kaye; Jerry Cohen

(57) ABSTRACT

A lumenaire system for providing varied types of illumination having a structural frame with hubs disposed in a spatial configuration and joining members providing structure and stability between said hubs. There are quasi point light sources mounted at specific points on the structural frame for providing a radiant illumination from said lumenaire system and an optical system for distributing the radiant illumination as a specific light pattern.

15 Claims, 12 Drawing Sheets

LUMENAIRS HAVING STRUCTURALLY AND ELECTRICALLY INTEGRATED ARRANGEMENTS OF QUASI POINT LIGHT SOURCES, SUCH AS LEDS

REFERENCE TO RELATED APPLICATIONS

The present application is based on and claims the priority of provisional application Ser. No. 61/000,411 filed Oct. 25, 2007. The substance of that application is hereby incorporated herein by reference.

FIELD OF INVENTION

This invention relates generally to the lighting art, and, more particularly to a luminaire that provides space filling patterns.

SUMMARY OF THE INVENTION

The present invention provides efficient lighting products, such as fixtures and light bulbs, that project beams of light from single or multiple light sources such as LEDs.

The invention also provides lighting systems that can produce uniform and homogenized illumination from multiples of colored light The lumenaire system of the present invention provides space filling patterns of radiant flux from multiple light sources to fulfill various illumination requirements.

The invention also provides a component system that can be assembled for varied configurations of light producing elements and related illumination distribution patterns thereof.

The invention further provides a structural frame and electrical continuity for multiple light sources.

BRIEF DESCRIPTION OF THE DRAWINGS

These and other objects, features and advantages will be apparent from the following detailed description of preferred embodiments taken in conjunction with the accompanying drawings in which.

DETAILED DESCRIPTION OF PREFERRED EMBODIMENTS

Figure 1:
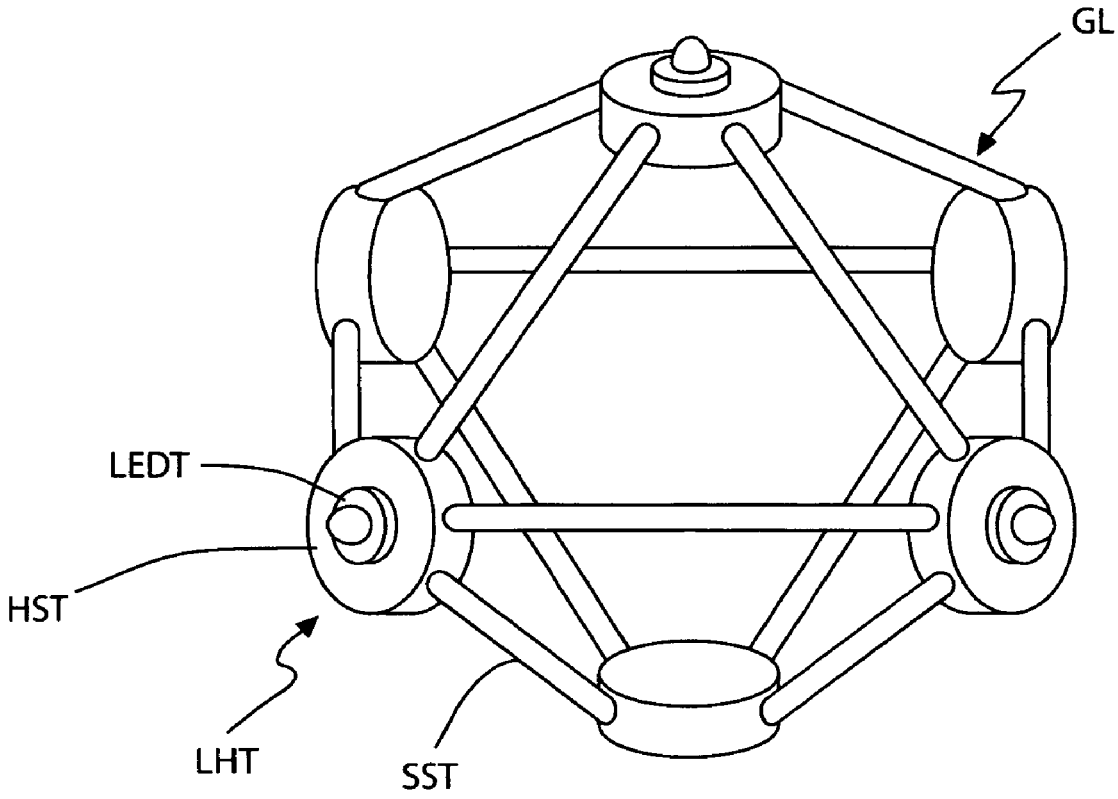
FIG. 1 is an isometric diagram of a lumenaire system comprising a geometric configuration of illuminating and structural elements.

FIG. 1 is an isometric diagram of a lumenaire system GL comprising a geometric configuration of the following illuminating and structural elements: a typical structural connecting hub LHT that serves as a heat sink to which a typical LED LEDT light producing module is mounted and to which typical structural strut STT is connected, forming a supporting bridge to an adjacent structural hub. STT can also be composed and fabricated of electrically conductive material providing electrical continuity between the LEDs that are mounted to the structural hubs LHT, which is further illustrated in FIGS. 2 and 2A. Typical structural hubs LHT can be connected to each other by other types of structural struts like those illustrated and described in FIGS. 4, 4A, and 5; struts STT may also be fabricated of rigid or flexible wire.

Figure 2A:
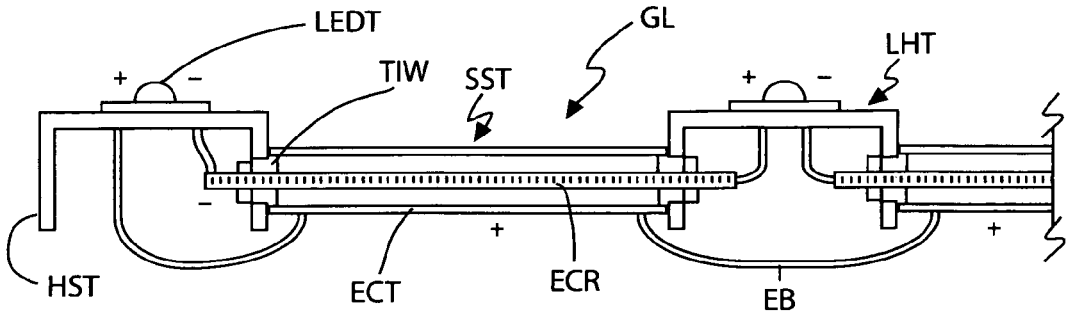
FIG. 2A is a cross-sectional diagram illustrating a partial view of a lumenaire system illustrating the electrical connection between the light sources.
Figure 2:
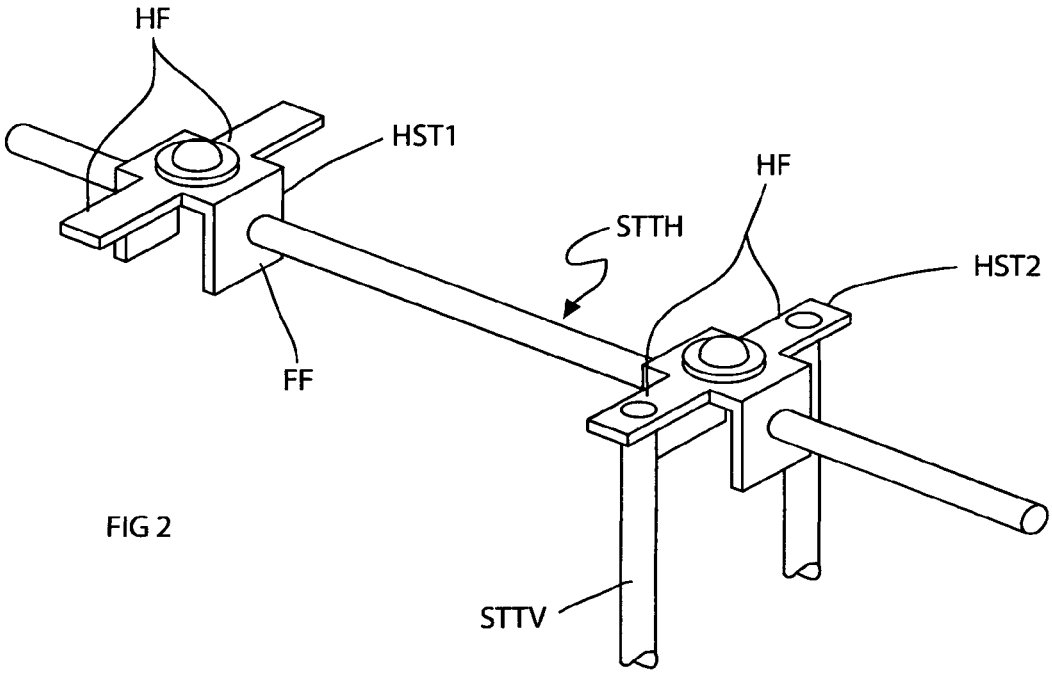
FIG. 2 is a three dimensional diagram illustrating a partial view of components used to construct the lumenaire system in FIG. 1.

FIG. 2 is a three-dimensional diagram illustrating a partial view of the components that can be used to construct a lumenaire system similar to (but not limited to) that described in FIG. 1 comprising two typical heat sinks HST1 and HST2 connected by typical structural strut STTH; the function of these elements is further described in FIG. 2A. Each heat sink (as in this diagram) has (but is not limited to two in other configurations) four fins, two of which HF radiate outward from the heat sinks while two fins FF are angled to provide connecting surfaces to structural strut STTH. Further, the fins HF, radiating outwardly from HST, provide a connecting surface to typical structural struts STTV, which can be at an angle to structural struts STTV.

FIG. 2A is a cross-sectional diagram illustrating a partial view of a lumenaire system GL comprising two typical structural connection hubs LHT comprising typical heat sinks HST that are illustrated as being cup shaped, the sides of which provide a surface to which typical structural struts STT can be connected. Structural strut STT is comprised of an electrical conductive rod ECR surrounded by an electrically conductive tube ECT that are electrically isolated from each other and from the typical heat sink HST by typical insulating shoulder washers IWT. In this diagram, ECT supplies positive electrical current to the typical LED LEDTs while ECR provides an alternating series continuity of positive and negative current between the LEDTs and the power source, if the typical LEDTs are of the alternating current (AC) variety. Connector EB provides electrical continuity between the ECT connectors. One function of structural strut STT is to provide a complete circuit to the quasi point sources of the geometric arrangement of the LEDs that are mounted to the structural hubs. In some arrangements a parallel-type circuit is used to connect the LEDs.

Figure 3:
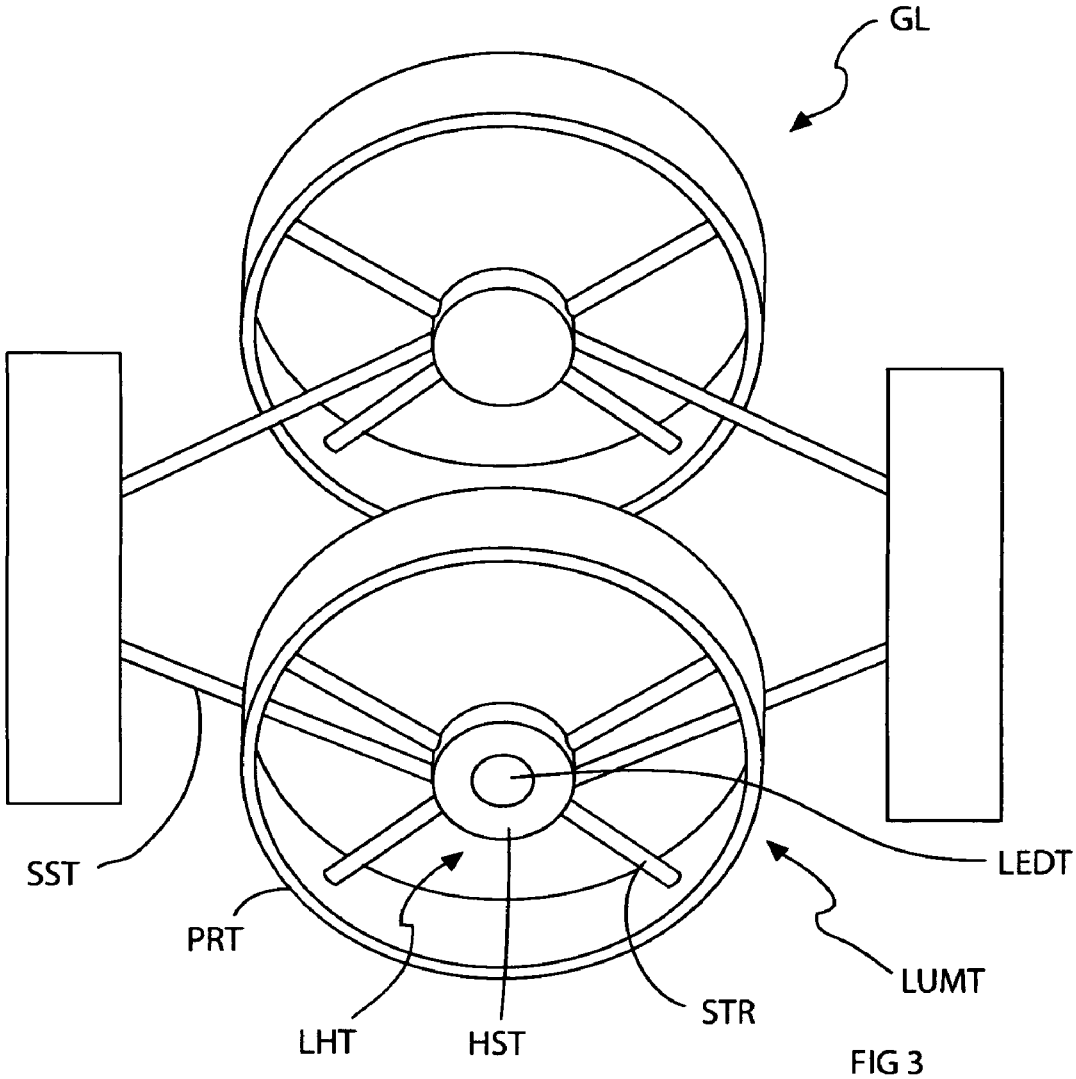
FIG. 3 is a three dimensional diagram of a lumenaire system comprising illumination modules arranged in a geometric configuration.

FIG. 3 is a three dimensional diagram of a lumenaire system GL further comprising four typical illumination modules LUMT arranged in a geometric configuration; each of which is constructed of a structural connector hub LHT as described in FIG. 1 connected to other typical LHT hubs by typical structural connection struts SST also described in FIG. 1, further comprising a refractive or reflective ring PRT which is connected to structural supporting hub LHT by typical radial supporting strut STR. Radial supporting strut STR can provide electrical continuity as struts STT described in FIGS. 1, 2, and 2A or be composed of non-conductive material so as to perform a structural function only.

Figure 3A:
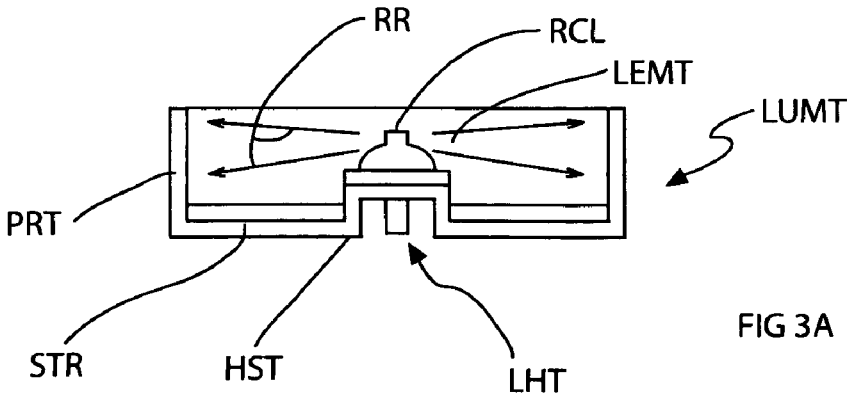
FIG. 3A is a cross-sectional diagram of a typical illumination module as illustrated in FIG. 3.

FIG. 3A is a cross-sectional diagram of a typical illumination module LUMT as illustrated in FIG. 3, further comprising a light radiating module LEMT mounted to the typical heat sink HST. The LED within the light radiating module LEMT is at least partially surrounded by a radially collimating lens RCL which collects and projects the light radiating from the LED as radially collimated beam RR towards and onto refractive or reflective ring PRT. Further explanations and descriptions of the relationships between radially projected collimating light is incorporated herein—in U.S. Pat. No. 5,897,201.

Figure 4:
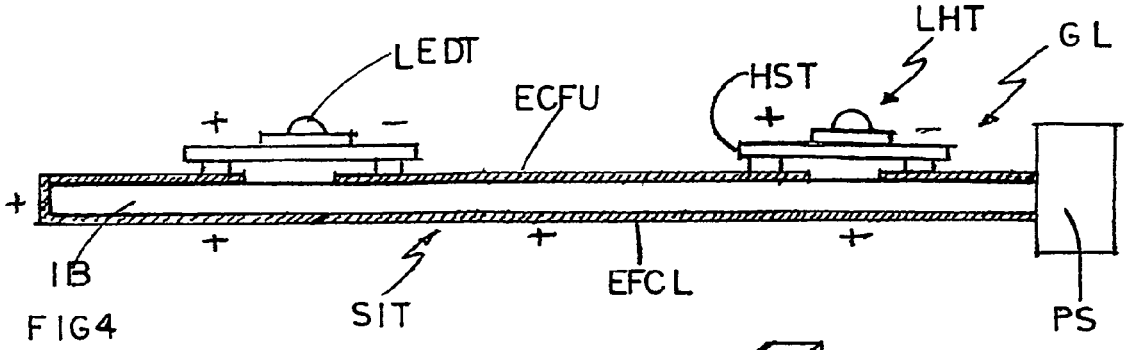
FIG. 4 is a side view diagram illustrating a partial view of a lumenaire system similar to that of FIG. 2.

FIG. 4 is a side view diagram illustrating a partial view of a lumenaire system GL similar to that illustrated in FIG. 2, differing in that the typical heat sinks HST of hubs LHT within FIG. 4 are connected by a strut SIT which is fabricated as a bar IB, the material of which is electrically insulating, onto which electrically conductive films ECFL and ECFU are adhered. FIG. 4 further illustrates a series circuit; conductive film ECFL carries positive current from the power source PS to one of the typical LEDs LEDT while conductive film ECFU provides continuity between the alternating positive and negative poles of the LED back to the power source PS.

Figure 4A:
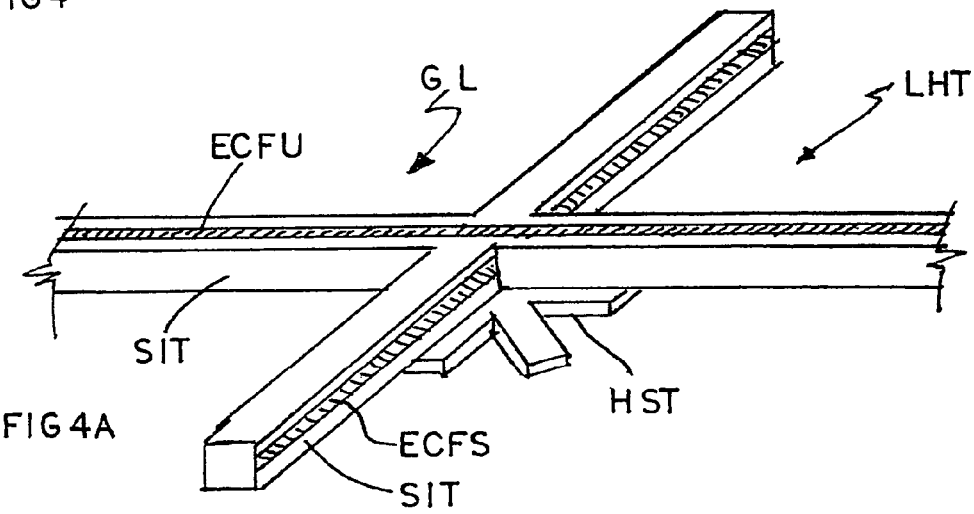
FIG. 4A is a three dimensional diagram of a lumenaire system illustrating electrically conductive film used to electrically link the light sources.

FIG. 4A is a three dimensional diagram illustrating a partial view of a lumenaire system GL comprising two typical intersecting struts SIT crossing at typical heat sink HST. Electrically conductive film ECFU is adhered to the top of structural strut SIT and electrically conductive film ECFS is adhered to a side of typical structural strut SIT. Heat sink HST can provide a structural connection between the typical structural struts SIT, or the structural struts SIT can be connected in other ways such as fusing or gluing to each other; or by connecting to hubs that are not the heat sink of the LED.

Figure 4B:
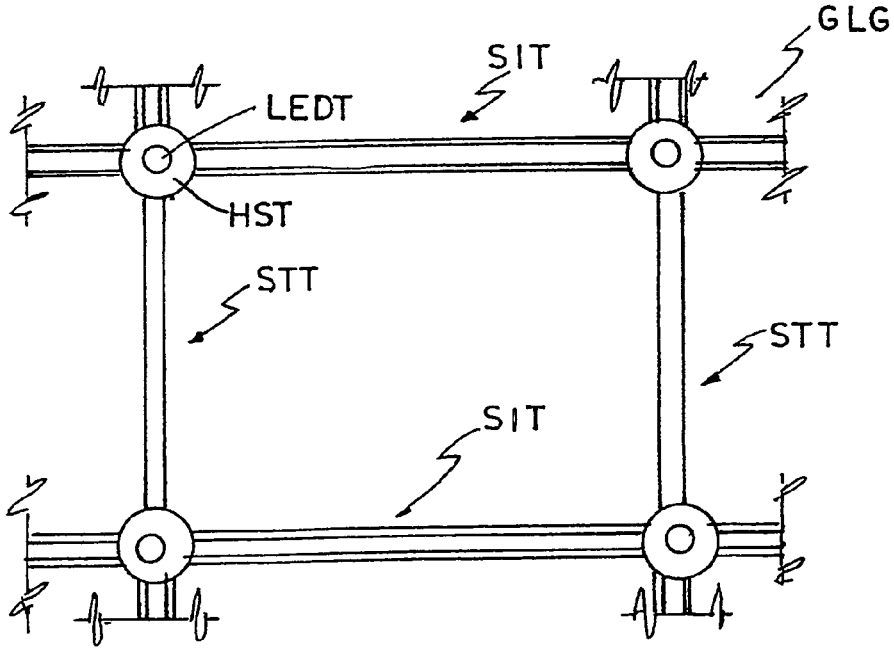
FIG. 4B is a plan diagram illustrating a partial view of a lumenaire system comprised of elements illustrated in FIGS. 4 and 4A arranged in a geometric planar pattern.

FIG. 4B is a plan diagram illustrating a partial view of a lumenaire system GLG comprising the elements of the lumenaires (such as typical LED LEDT and structural struts SIT), arranged in a planar geometric pattern, illustrated and described in FIGS. 4 and 4A and further incorporating the types of structural struts STT as illustrated in FIGS. 2 and 2A.

Figure 5:
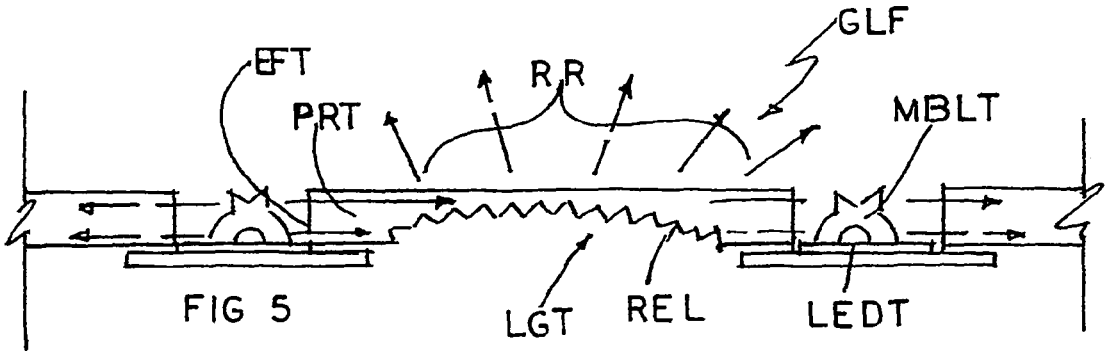
FIG. 5 is a cross-sectional diagram illustrating a partial view of a lumenaire system illustrated in FIG. 4.

FIG. 5 is a cross-sectional diagram illustrating a partial view of lumenaire system GLF, similar in structure to the lumenaire GL in FIG. 4; differing in that the light emanating from typical LEDs LEDT are collected and projected by multiple beam collimators MBLT as individually collimated beams PRT. Multiple beam collimators are further explained in, and incorporated herewith in pending patent Ser. No. 11/034,395. Further, struts LGT function as light guides for individually collimated beams PRT which can be refracted by prismatic surfaces REL as radiant light RR. This type of refractor can be further explained and incorporated herein in U.S. Pat. No. 6,540,382.

Figure 5A:
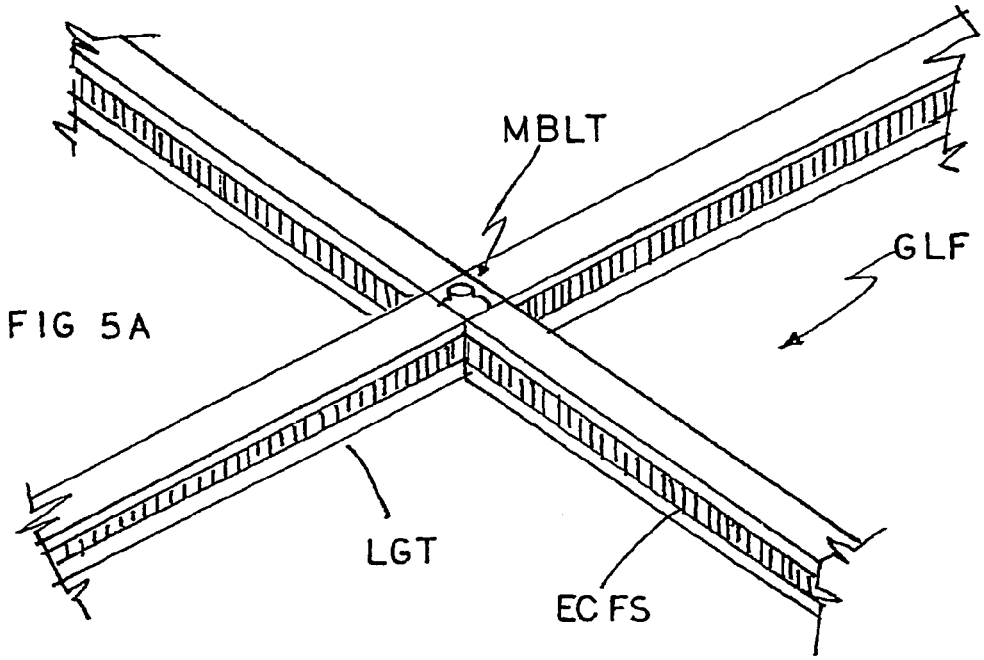
FIG. 5A is a three dimensional diagram illustrating a partial view of a lumenaire system as described in FIG. 5.

FIG. 5A is a three-dimensional diagram illustrating a partial view of a lumenaire system GLF as described in FIG. 5 further illustrating two typical light guides LGT intersecting at multibeam collimator MBLT. A conductive film ECFS (as illustrated in FIG. 4A) can be used to conduct power along light guides LGT.

Figure 6:
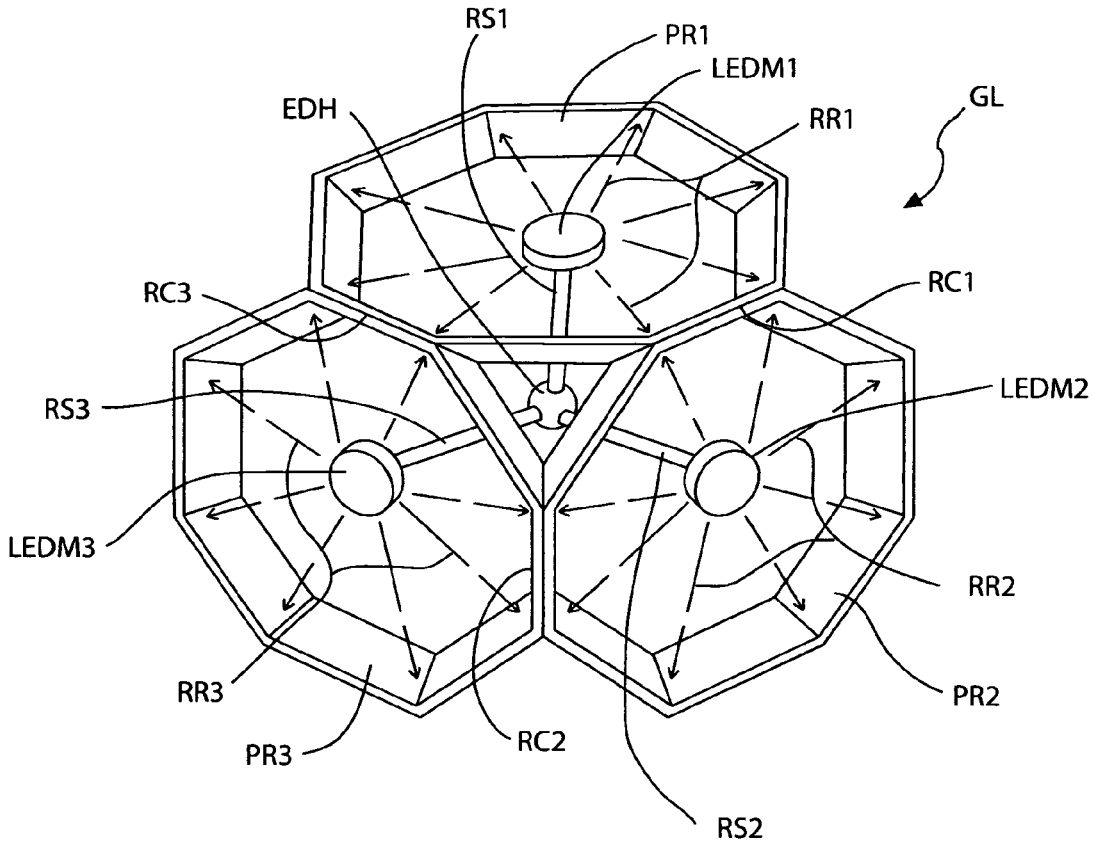
FIG. 6 is a three dimensional diagram illustrating a partial view of a lumenaire system in the form of a polyhedron.

FIG. 6 Is a three dimensional diagram illustrating a partial view of a lumenaire system GL in the form of a polyhedron constructed of three intersecting prismatic shapes PR1, PR2 and PR3, each receiving radially collimated beams RR1, RR2 and RR3 respectively projecting from LED modules LEDM1, LEDM2, and LEDM3 respectively which emanate (radiate outward) from central hub EDH which provides support and electrical distribution. The construction of the structural struts can comprise and be of, but not limited to, the strut type described in FIGS. 1 through 5. The junction RC1 of prismatic shapes PRI and PR2, the junction RC2 of prismatic shapes PR2 and PR3, and the junction RC3 of prismatic shapes PR3 and PR1 can mix and distribute radially collimated beams RR1 and RR2; RR2 and RR3; and RR3 and RR1 simultaneously.

Figure 6A:
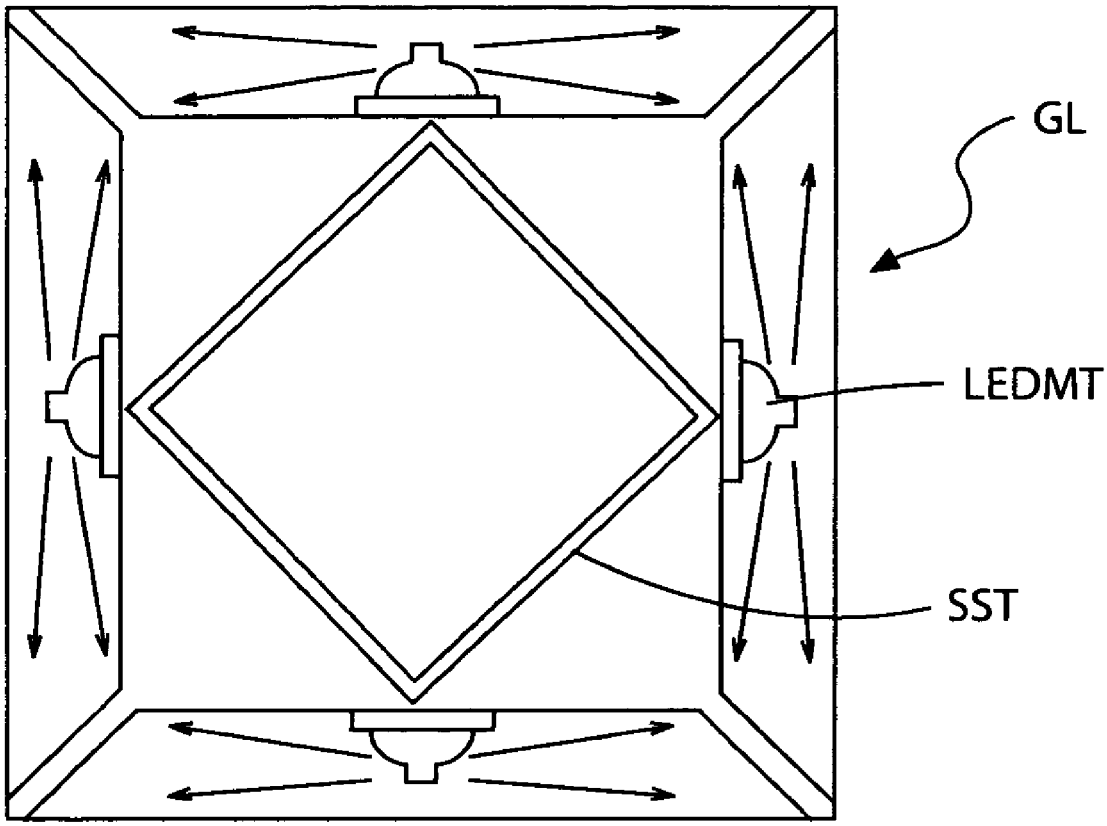
FIG. 6A is a plan view diagram illustrating a partial view of a lumenaire system similar in construction and function to that shown in FIG. 6.

FIG. 6A is a plan view diagram illustrating a partial view of a lumenaire system GL similar in construction and function to that shown in FIG. 6, differing in that the typical structural struts STT provide a structural link between the typical LEDMT modules.

Figure 7:
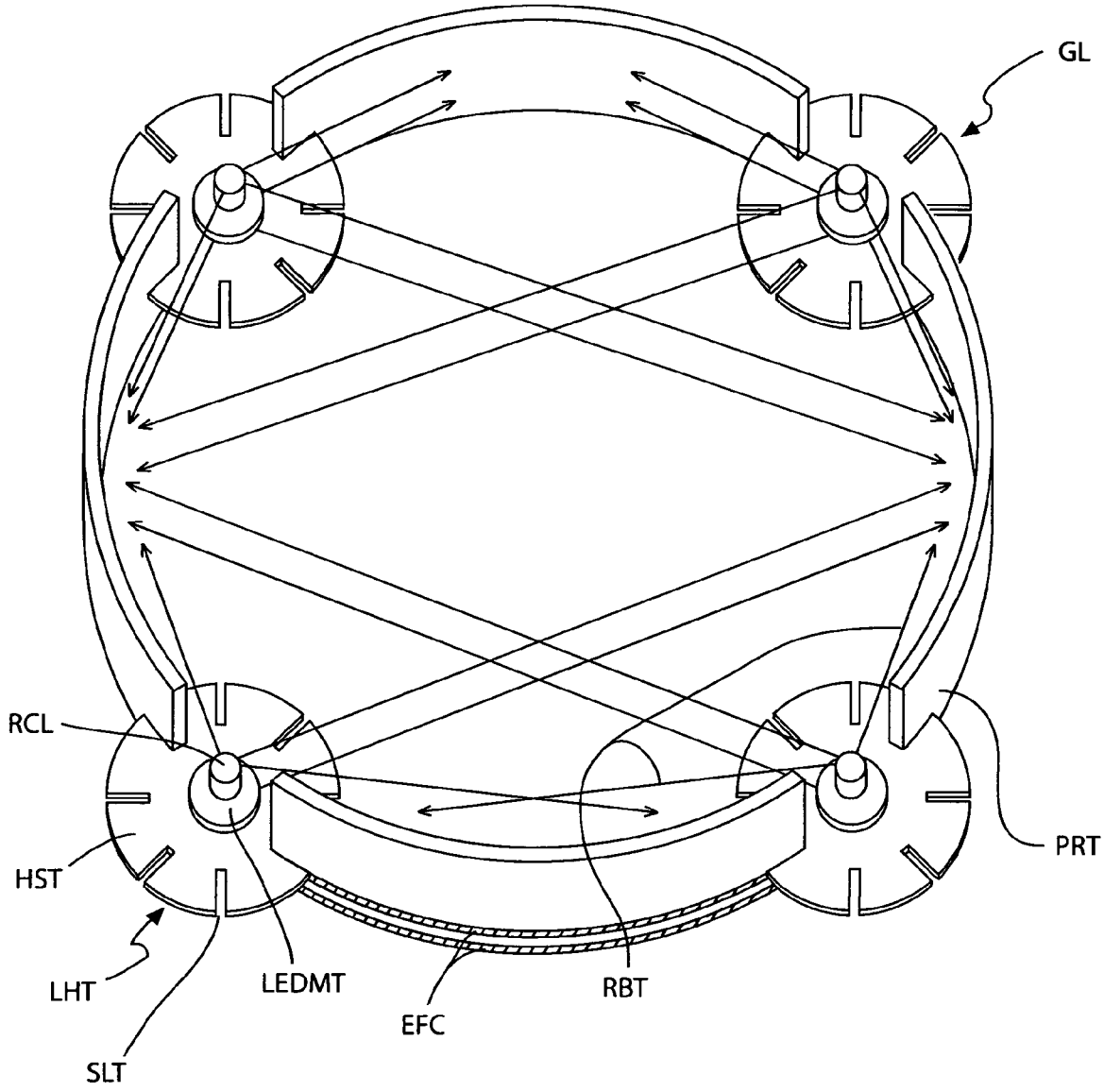
FIG. 7 is a three dimensional diagram illustrating a portion of a lumenaire system comprising a structurally integrated geometric arrangement of structural and illuminating components.
Figure 7A:
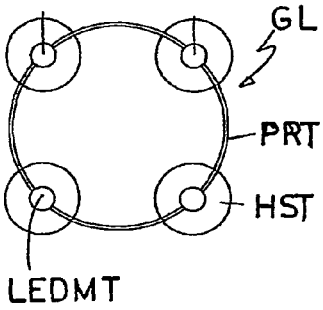
FIG. 7A is a plan view of FIG. 7.

Next FIGS. 7 and 7A are to be described. FIG. 7 is a three dimensional diagram of a portion of a lumenaire system GL comprising a structurally integrated geometric matrix of the following structural and illuminating components: an arrangement of typical LEDM modules, each comprised of an LED Light Emitting Diode mounted to a heat sink HST (in this embodiment illustrated having a disk shape), each LEDMT at least partially surrounded by a radially collimating lens RCL; and an arrangement of typical prismatic bands PRT structurally connecting the heat sinks. FIG. 7A is a plan view of FIG. 7.

The prismatic bands PRT refract and or reflect the radial beams RBT projected by the typical LED modules LEDMT. In this embodiment each of the typical prismatic bands PRT receives light from all of the typical LED modules LEDMT so that if the color of the typical LEDMT modules were each different they would overlap and mix on the typical prismatic bands PRT.

A further component that can comprise the lumenaire system GL is electrically conductive material EFC which can be adhered to the typical prismatic bands PRT to provide current to and between the LEDMT modules. Prismatic Bands PRT can be prismatic or diffusing material such as plastics or glass or may be reflective materials such as plastics or glass, or may be reflective materials such as coated plastics and glass or various polished metals.

In this embodiment, typical prismatic band PRT is attached to heat sink HST by pressing typical prismatic band PRT into slots SLT within typical heat sink HST. Other ways of attachment include but are not limited to adhesives, various fasteners, and welding.

Figure 7B:
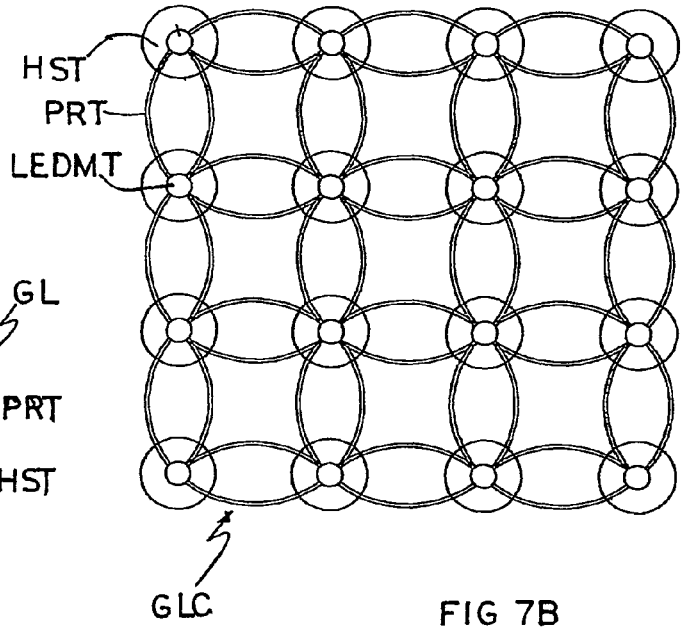
FIG. 7B is a plan view diagram of a geometric arrangement of portions of a lumenaire system as described in FIG. 7.

FIG. 7B is a plan view diagram of a compound lumenaire system GLC comprised of groupings of the lumenaire portions that are illustrated in FIGS. 7 and 7A. In this embodiment all the LEDMT modules are interconnected by connecting the prismatic bands to the typical heat sinks. However, in another embodiment the prismatic bands can be attached to a plane that is substantially parallel to the plane on which the LEDMT modules are disposed.

Figure 8:
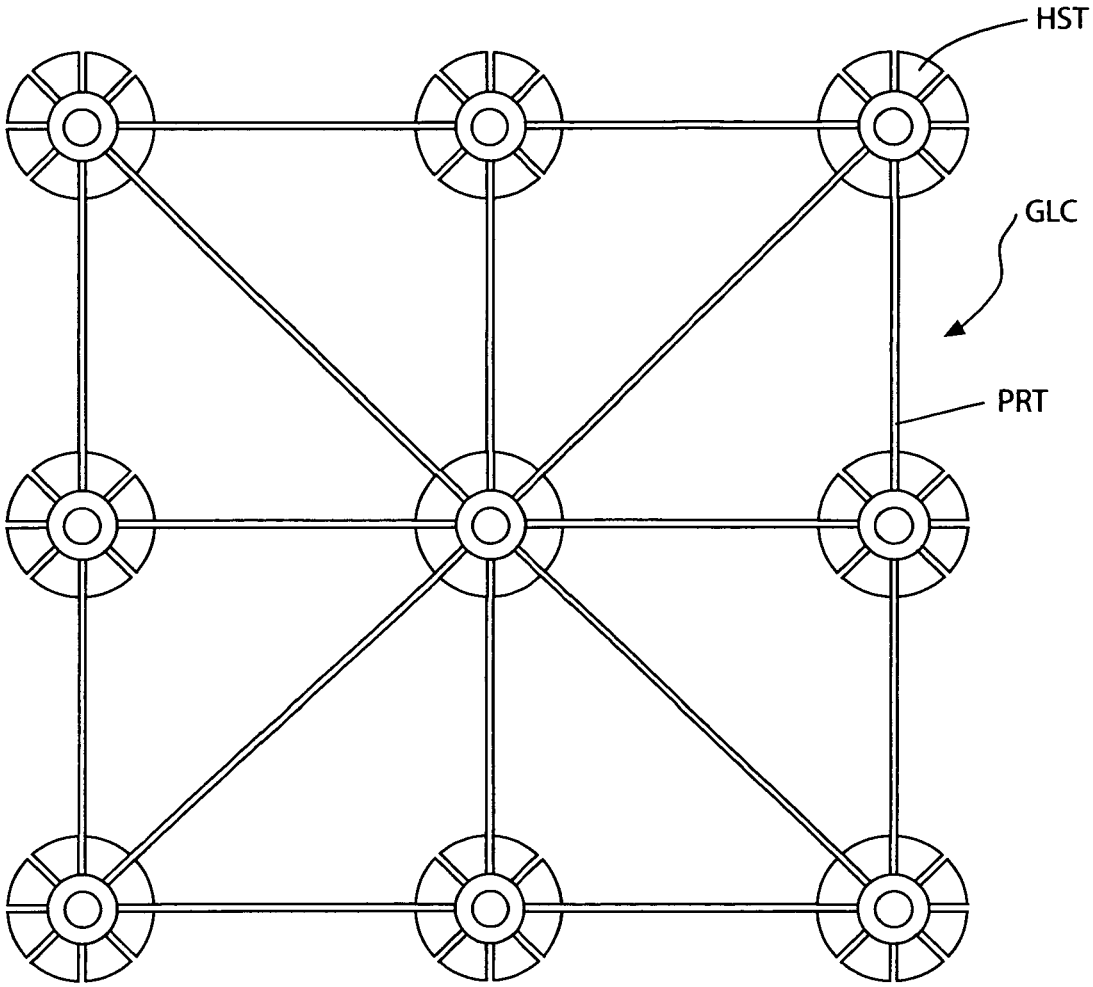
FIG. 8 is a plan view diagram of a lumenaire system similar to the lumenaire illustrated in FIG. 7.

FIG. 8 is a plan view diagram of a lumenaire system GLC similar to the lumenaire GL illustrated in FIG. 7 showing that the typical prismatic bands PRT can be straight (or any other shape) and that the geometric configuration of the typical prismatic bands PRT in relationship to the typical heat sink HST can also be varied.

Figure 9:
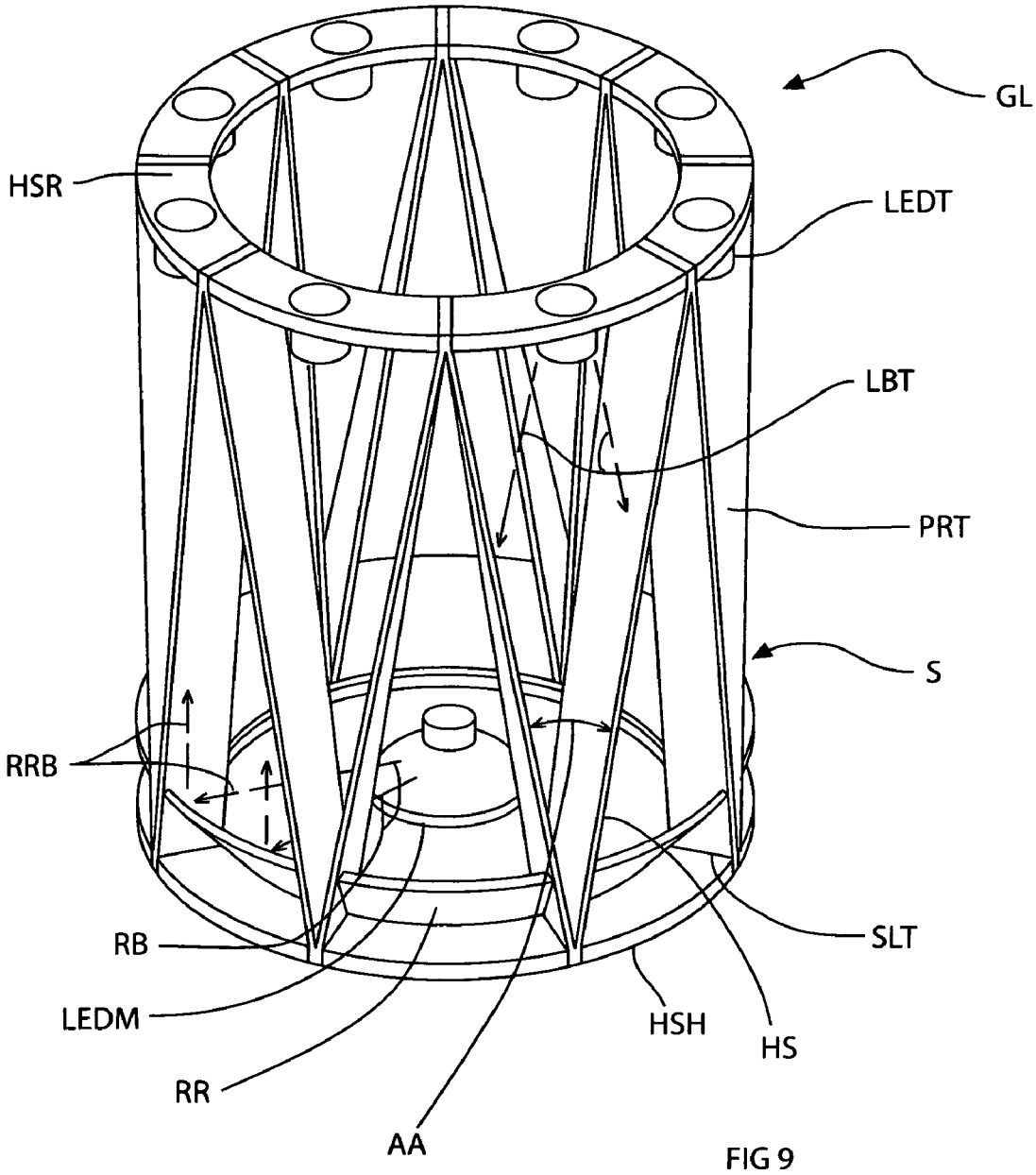
FIG. 9 is an isometric view of a lumenaire system fabricated in the form of a cylinder.

FIG. 9 is an isometric view of a lumenair system GL substantially in the form of a cylinder (and or other three dimensional polyhedral shapes) fabricated from a top component and a bottom component which in this embodiment are heat sinks HSR and HSH respectively. The sides S of the cylinder are comprised of prismatic bars PRT which act as a structural connection between the top and bottom components HSR and HSH. One way for lumenaire GL to provide illumination is by mounting to typical LED modules LEDT to heat sink HSR which and to direct them as to project typical collimated beams LBT between and onto typical prismatic bars PRT. The angle AA which prismatic bars PRT are disposed in relationship to each other is such as to form an optical wedge and therefore provide evenly distributed illumination on and from the surfaces of said typical prismatic bars. Lumenair GL can also provide illumination by LED module LEDM projecting a radially collimated beam RB towards and onto substantially conical reflector RR which in tern reflects radially collimated beam RR as substantially tubular shaped beam RRB towards and onto typical prismatic bars PRT. Prismatic bars can be fabricated from various type of optical materials such as plastics, glass, reflective material and films or other material that have been treated with various paint and other coatings.

Figure 10:
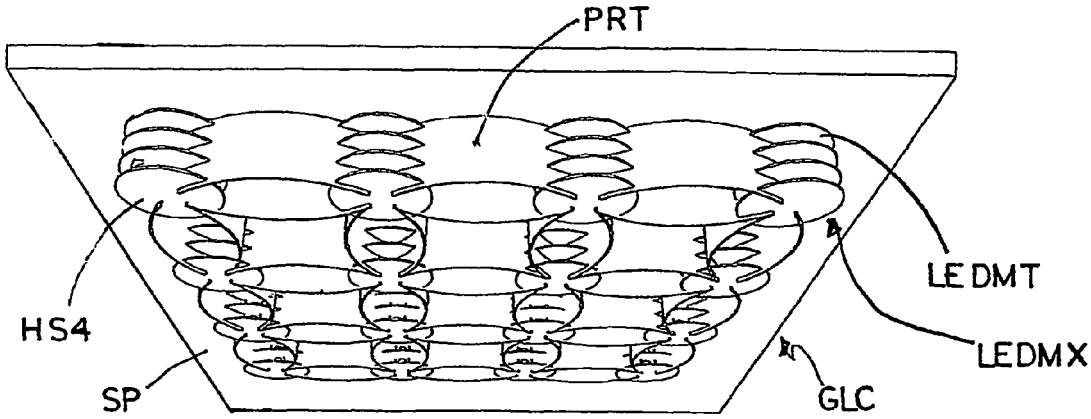
FIG. 10: is a three dimensional diagram of a lumenaire system comprising stacks of LED modules mounted to a plane.

FIG. 10 is a three dimensional diagram of a compound lumenaire system similar to that illustrated in FIG. 7B differing in that the single typical LEDMT module in FIG. 7B has been replaced by a stack of said modules LEDMX. Each stack is shown to comprise (in this embodiment) four HST4 heat sinks which make up the structural hub of the system. The function of said stacks of modules LEDMX and the single LEDMT modules are further explained in FIG. 10A. Also compound lumenaire system GLC is shown to be mounted on plane SP which could be comprised of a structural material providing support and optical functions such as reflection, refraction, and diffusion for said stack of LEDMX modules. Plane SP can be made of opaque, reflective, clear or refractive material depending upon the desired light distribution and aesthetic effects of compound lumenaire system GLC. As described in FIG. 4, a conductive film can be applied to plane SP to provide power to said stacks of modules. Plane SP can also be an architectural surface such as a floor, ceiling, or wall.

Figure 10A:
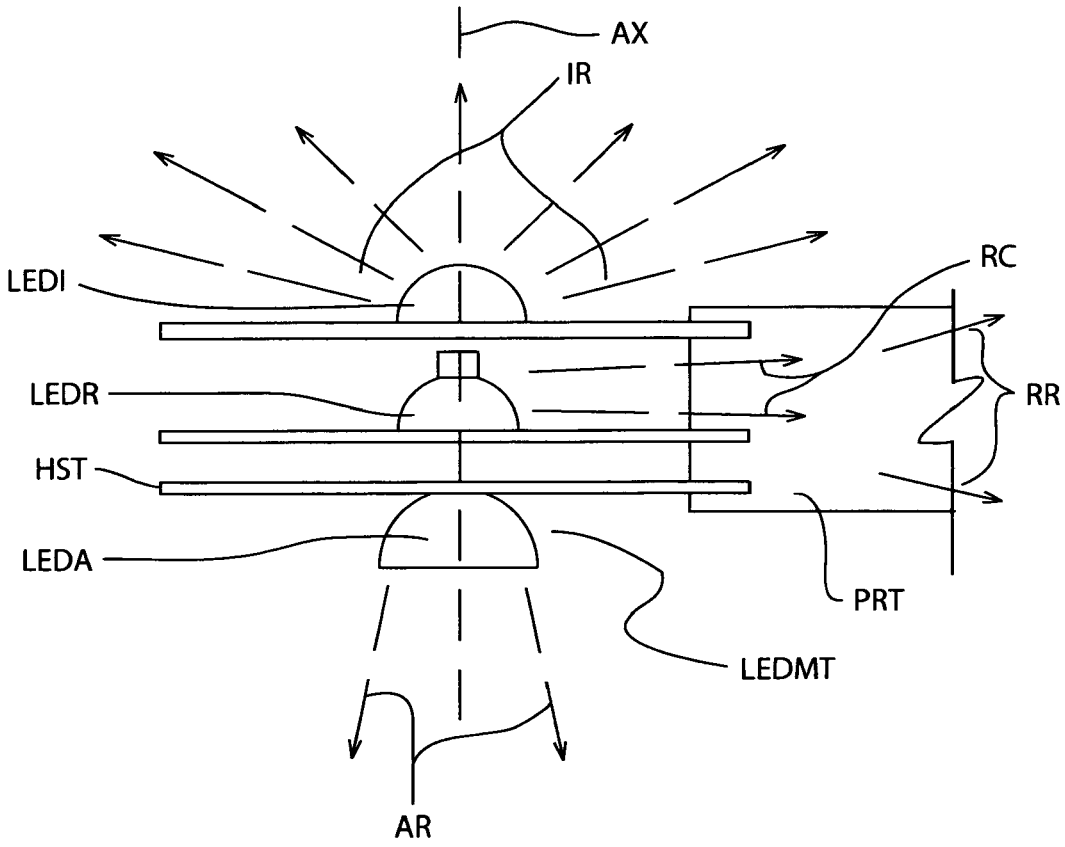
FIG. 10A: is a side view of a section of a stack of LED modules providing a variety of light distributions.

FIG. 10A: is a side view of a section of a stack of LEDMT light producing modules LEDMX on a common optical axis AX illustrating that each of said modules can comprise a differing optical configuration and therefore provide different light distribution patterns. Light producing modules LED1 comprise a lens that provides a light pattern IR suitable for indirect illumination, LEDR comprises the combined elements and function of a radially collimated lens projecting a radially collimated beam RC and onto a refractor PRT as described in FIG. 7, and said combined elements producing refracted rays RR suitable for ambient illumination. Module LDA comprises a parabolic or ellipsoidal projecting reflector projecting a concentrated beam AR suitable for accent or downlight illumination. Combinations of said light producing modules LEDF, LEDR and LEDA can comprise all of the LEDMT modules in complete GLC luminaire systems as illustrated in FIG. 10A and can be mixed with single LEDMT modules as illustrated in FIG. 7B. Said light producing modules LEDI, LEDR and LEDA may be switched in groups or individually to produce said indirect, ambient, or accent lighting to function individually or in varied combinations.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

The invention claimed is:

1. A lumenaire system comprising:

a geometric arrangement of at least two light projecting modules, each module including a quasi point light source on an optical axis; an optical component at least partially surrounding and collecting light from, and projecting a beam away from the light source and the optical axis;

a mounting on which the quasi point light source and optical component are mounted; and a structural frame of illuminated and illuminating structural members of which provide a connection between and joining said light modules, at least one of the structural members receiving and redistributing a beam from at least one of said light modules;

at least two light modules connected to each other by at least one structural member which is a prism band;

each light module comprising a quasi point light source at least partially surrounded by a beam projecting optic projecting radial beam away from the light module onto said prism band; and the prism band fabricated from a material that provides a structural connection between the quasi point light source while receiving, mixing, and redirecting the radially projected beam from at least two light modules.

2. A lumenaire system as in claim 1 wherein the spatial disposition and arrangement of structural members join to form a polyhedron.

3. A lumenaire system as in claim 1 wherein said spatial disposition and arrangement of said structural members join to form a plane.

4. A lumenaire system as in claim 1 wherein the quasi point light sources are LEDs and the mountings to which the LEDs are attached are heat sinks that dissipate the heat generated by said LEDs.

5. A lumenaire system as in claim 1 wherein at least one of the structural members includes a light guide providing structure and an illuminating element between said light modules from said lumenaire system.

6. A lumenaire system as in claim 1 wherein said illuminating structural members further comprise electrically conductive material providing continuity between said quasi point light sources.

7. A lumenaire system as in claim 1 wherein the structural members comprise reflective material so as to redirect the radiant light from at least one light module.

8. A lumenaire system as in claim 1 wherein the prism bands include refractive material that receives and mixes light from said light modules.

9. A lumenaire system as in claim 1 wherein at least one of the light modules include at least two quasi point light sources at least one of which is at least partially surrounded by a beam projecting optic.

10. A lumenaire system as in claim 9 wherein at least one of said quasi point light sources includes a different optical component from another quasi point light source for providing different light distributions, at least one of the optical components projecting a radial beam onto a prism band.

11. A lumenaire as in claim 9 wherein the at least two quasi point light sources share the optical axis.

12. A lumenaire system as in claim 1 wherein each quasi point light source can be independently switched.

13. A luminaire as in claim 1 wherein a conductive film is applied to said structural members providing power to and between said quasi point light sources.

14. A lumenaire system as in claim 1 wherein said at least one optical component of the light projecting modules is a multibeam collimator, projecting at least two individual beams away from the light module.

15. A lumenaire as in claim 1 wherein the quasi point light source is an LED and the mounting component is a heat sink.

* * * * *